US009883709B2

(12) United States Patent
Penner et al.

(10) Patent No.: US 9,883,709 B2
(45) Date of Patent: Feb. 6, 2018

(54) MECHANICALLY JOINED HELMET BODIES AND METHOD FOR SAME

(71) Applicant: Bell Sports, Inc., Scotts Valley, CA (US)

(72) Inventors: Benjamin W. Penner, Santa Cruz, CA (US); Ben D. Pritz, Santa Cruz, CA (US); Gregg T. Jacobsen, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 0 days.

(21) Appl. No.: 15/395,558

(22) Filed: Dec. 30, 2016

(65) Prior Publication Data

US 2017/0347743 A1 Dec. 7, 2017

Related U.S. Application Data

(60) Provisional application No. 62/347,054, filed on Jun. 7, 2016.

(51) Int. Cl.

| | |
|---|---|
| ***A42C 2/00*** | (2006.01) |
| ***A42B 3/06*** | (2006.01) |
| ***A42B 3/28*** | (2006.01) |
| ***A42B 3/32*** | (2006.01) |

(52) U.S. Cl.

CPC ..... *A42C 2/002* (2013.01); *A42B 3/063* (2013.01); *A42B 3/065* (2013.01); *A42B 3/283* (2013.01); *A42B 3/32* (2013.01)

(58) Field of Classification Search

CPC ..... A42B 3/063; A42B 3/283; A42B 3/065

USPC ..... 2/410, 421

See application file for complete search history.

(56) References Cited

U.S. PATENT DOCUMENTS

| | | | | |
|---|---|---|---|---|
| 4,587,676 | A * | 5/1986 | Estadella | A42B 3/322 2/424 |
| 5,813,055 | A | 9/1998 | Egger | |
| 6,301,720 | B1 * | 10/2001 | Bataille | A42B 3/32 2/422 |
| 6,442,765 | B1 * | 9/2002 | Fallon | A42B 3/066 2/410 |

(Continued)

FOREIGN PATENT DOCUMENTS

| | | |
|---|---|---|
| WO | 9846095 | 10/1998 |
| WO | 0057739 | 10/2000 |
| WO | 0226069 | 4/2002 |

*Primary Examiner* — Katherine Moran

(74) *Attorney, Agent, or Firm* — Booth Udall Fuller, PLC

(57) ABSTRACT

A helmet can include an upper body comprising an interior surface comprising a locking flange, and a lower body positioned at least partially inside the upper body. The lower body can comprise an edge in contact with the locking flange of the upper body. At least one joining pin can be located within, and bridge, the lower body and the upper body. An at least one basket pair can comprise an upper basket comprising a pin receiver, the upper basket being at least partially embedded within the upper body. A lower basket can comprise a pin aperture, the lower basket being at least partially embedded within the lower body and positioned such that the pin aperture is aligned with the pin receiver of the basket pair. The at least one joining pin can be positioned inside both the pin aperture and the pin receiver of the basket pair.

18 Claims, 11 Drawing Sheets

(56) References Cited

U.S. PATENT DOCUMENTS

| | | | | |
|---|---|---|---|---|
| 8,225,420 | B2 * | 7/2012 | Keillor | A42B 3/285 2/7 |
| 8,572,767 | B2 * | 11/2013 | Bryant | A42B 3/08 2/171.1 |
| 2003/0167558 | A1 * | 9/2003 | Broersma | A42B 3/225 2/410 |
| 2008/0189835 | A1 * | 8/2008 | Mangone | A42B 3/324 2/420 |

* cited by examiner

MECHANICALLY JOINED HELMET BODIES AND METHOD FOR SAME

RELATED APPLICATIONS

This application claims the benefit of U.S. provisional patent application 62/347,054, filed Jun. 7, 2016 titled "Mechanically Joined Helmet Bodies and Method for Same," the entirety of the disclosure of which is hereby incorporated by this reference.

TECHNICAL FIELD

Aspects of this document relate generally to helmets having mechanically joined helmet bodies and methods for the same.

BACKGROUND

Helmets function to provide protection while minimizing interference with the performance or enjoyment of an otherwise dangerous activity. The shape of a helmet may be adapted to provide both protection and comfort. For example, a helmet may be shaped to increase ventilation, or to reduce weight and volume. Some helmets are made up of two or more bodies of energy-absorbing material to form shapes that would be difficult, if not impossible, to achieve in a single molded piece. Conventional helmets are made by joining helmet bodies with adhesives, or by in-molding the helmet bodies together.

SUMMARY

A need exists for an improved helmet comprising mechanical attachment of multiple helmet bodies. Accordingly, in an aspect, a helmet can comprise an upper body comprising an interior surface comprising a locking flange. A lower body can be positioned at least partially inside the upper body, the lower body comprising an edge in contact with the locking flange of the upper body. At least one joining pin can be located within both the lower body and the upper body, bridging the lower body and the upper body. At least one basket pair can comprise an upper basket, a lower basket, and at least one joining pin. The upper basket can comprise a pin receiver, the upper basket being at least partially embedded within the upper body. The lower basket can comprise a pin aperture, the lower basket at least partially embedded within the lower body and positioned such that the pin aperture is aligned with the pin receiver of the basket pair. The at least one joining pin can be positioned inside both the pin aperture and the pin receiver of the basket pair.

The helmet can further comprise the locking flange being proximate a front rim of the upper body, and the at least one joining pin being proximate a rear rim of the upper body. The upper basket of the at least one basket pair can be in-molded within the upper body, and the lower basket of the at least one basket pair can be in-molded within the lower body. The at least one joining pin can be releasably coupled to at least one of the pin receiver and the pin aperture of the at least one basket pair. At least a portion of an exterior surface of the lower body facing the interior surface of the upper body can be separated from the interior surface by an air gap. The at least one joining pin can be a single joining pin. The at least one joining pin can be fixedly coupled to at least one of the upper body and the lower body with an adhesive.

In another aspect, a helmet can comprise an upper body, a lower body positioned at least partially inside the upper body, and at least one joining pin located within both the lower body and the upper body, bridging and coupling the lower body and the upper body.

The helmet can further comprise the upper body comprising an interior surface comprising a locking flange, and the lower body comprising an edge in contact with the locking flange of the upper body. The locking flange can be proximate a front rim of the upper body, and the at least one joining pin can be proximate a rear rim of the upper body. At least a portion of an exterior surface of the lower body facing an interior surface of the upper body can be separated from the interior surface by an air gap. In some instances the at least one joining pin can be a single joining pin. In other instances the at least one joining pin can be at least two joining pins. In another aspect, the helmet can further comprise a basket pair comprising an upper basket comprising a pin receiver, the upper basket at least partially embedded within the upper body. A lower basket can comprise a pin aperture, the lower basket being at least partially embedded within the lower body and positioned such that the pin aperture is aligned with the pin receiver of the basket pair. The at least one joining pin can be positioned inside both the pin aperture and the pin receiver of the basket pair. The helmet can further comprise the at least one joining pin being releasably coupled to at least one of the pin receiver and the pin aperture of the respective basket pair. The upper basket of the basket pair can be in-molded within the upper body, and the lower basket of the basket pair can be in-molded within the lower body.

In another aspect, a method of assembling a helmet comprising an upper body and a lower body can comprise providing an upper body of the helmet, inserting a lower body of the helmet into the upper body of the helmet, and inserting a joining pin into both the lower body and the upper body through an interior surface of the lower body, such that the joining pin bridges and couples the lower body and the upper body.

The method of assembling the helmet can further comprise rotating the lower body within the upper body until an edge of the lower body is in contact with a locking flange on an interior surface of the upper body. The method can further comprise aligning the lower body with the upper body to form a basket pair comprising an upper basket in-molded within the upper body and a lower basket in-molded within the lower body, the lower basket comprising a pin aperture aligned with a pin receiver of the upper basket, and inserting the joining pin into both the lower body and the upper body by inserting the joining pin into the pin aperture and the pin receiver of the basket pair. The joining pin can be releasably coupled to at least one of the pin receiver and the pin aperture of the respective basket pair.

BRIEF DESCRIPTION OF THE DRAWINGS

The written description is presented in conjunction with the appended drawings, where like designations denote like elements, and.

DETAILED DESCRIPTION

Figure 1:
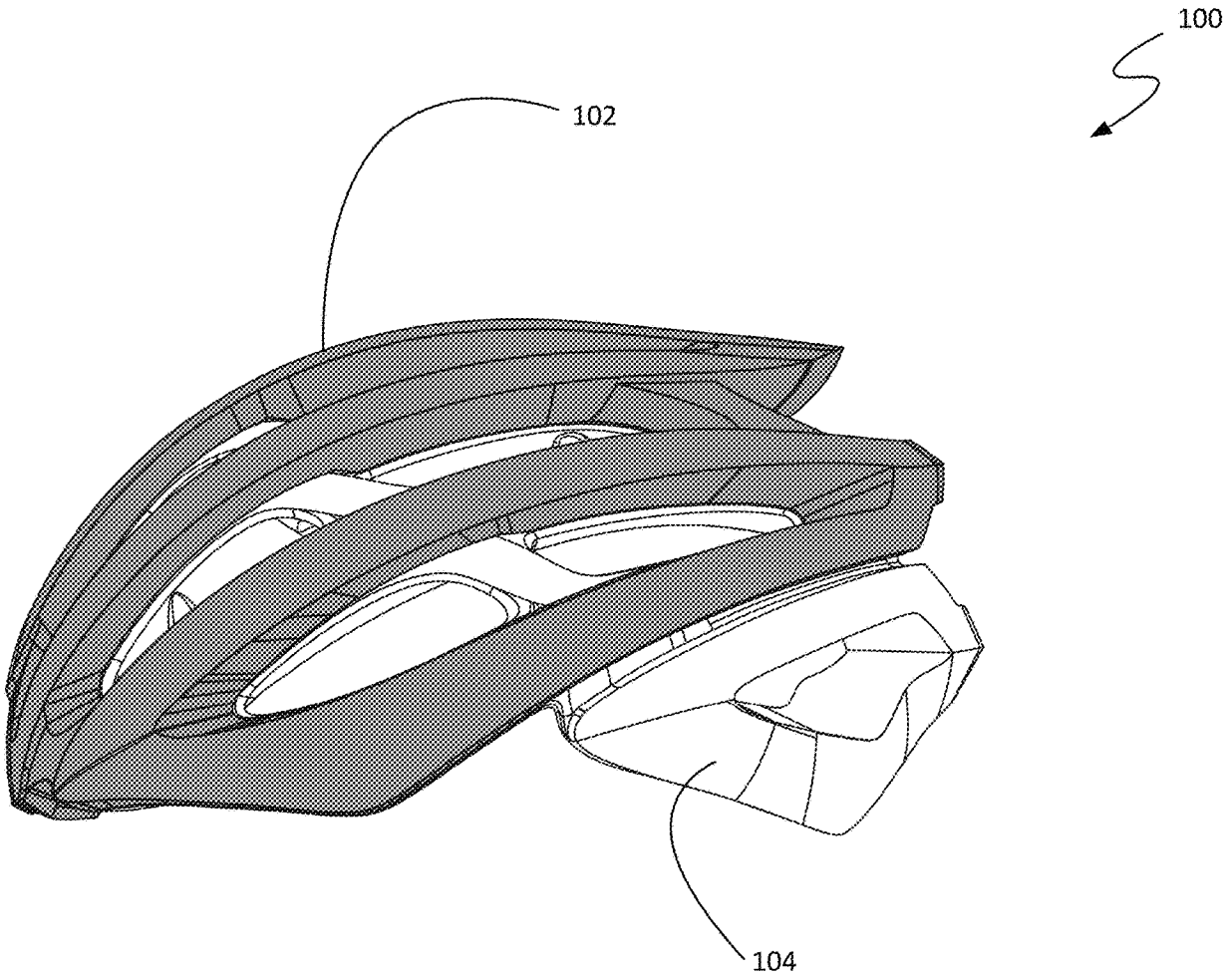
FIG. 1 is a side view of a helmet with mechanically joined helmet bodies.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, one or more of such implementations and implementing components may comprise any components, models, types, materials, versions, quantities, or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

A function of a helmet can be to provide protection to the wearer while minimizing interference with the performance and enjoyment of an otherwise dangerous activity. A helmet may be shaped to provide both protection and comfort. For example, a helmet may be shaped to maximize ventilation, or reduce weight. Some helmets are made up of two or more bodies of energy-absorbing material to form shapes that would be difficult, if not impossible, to achieve in a single molded piece.

Figure 2:
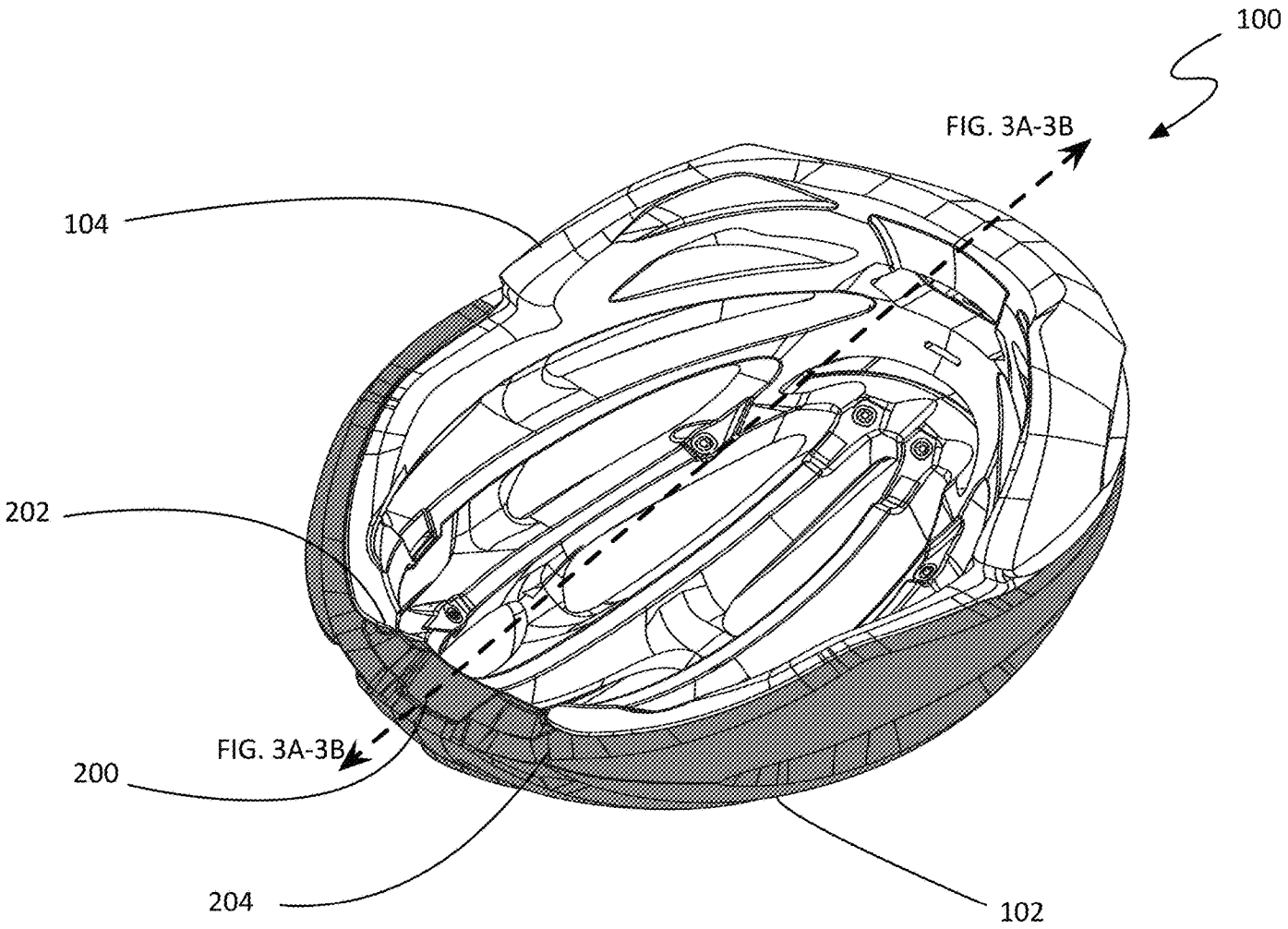
FIG. 2 is a bottom view of the helmet of FIG. 1.

Contemplated in this disclosure is a helmet having mechanically joined helmet bodies. FIGS. 1-3 depict non-limiting embodiments of a helmet 100 comprising an upper body 102 and a lower body 104. As shown, the helmet 100 can optionally comprise at least one locking flange 200 that can be positioned on, or formed as part of, a surface of the helmet, such as an interior surface 310 of the upper body 102, and can further be disposed at a front, side, or rear of the helmet 100. In other instances the locking flange 200 can be positioned on, or formed as part of, an outer surface 312 of the lower body 104, such as at front, side, or rear of the helmet 100. While the helmet 100 has been shown with the non-limiting example of two bodies, for example the upper body 102 and the lower body 104, additional bodies including intermediate or interstitial bodies can also be used, and one or more locking flanges 200 can also be present on the interstitial bodies. An edge 202 can be formed and mateably coupled or positioned adjacent the locking flange 200. When more than one flange 200 is present, more than one edges 202 can be correspondingly coupled or positioned the more than one flanges 200. The lower body 104 can optionally comprise an edge 202 proximate the locking flange 200. Furthermore, the helmet 100 comprises a joining pin 300 inside of and bridging the upper body 102 and the lower body 104. According to various embodiments, the locking flange 200 prevents the lower body 104 from rotating forward out of the upper body 102, while the joining pin 300 prevents the lower body 104 from rotating backward out of the upper body 102; together, the flange 200 and pin 300 prevent the lower body 104 from being pulled linearly out of the upper body 102.

Mechanically joining the lower body 104 and the upper body 102 of a helmet 100 using one or more joining pins 300, locking flanges 200, or both, is advantageous over conventional joining methods. Conventional helmets are made by joining helmet bodies with adhesives, or by in-molding the helmet bodies together. In-molding the bodies together does not allow for all of the tooling advantages possible when making helmets from two or more bodies, nor does it allow for a gap between helmet bodies. In-molding the bodies together can also be expensive and time consuming. Joining the bodies with adhesives can also be time consuming, adding additional processing and expense. Mechanically joining the helmet bodies, as shown in the non-limiting examples of FIGS. 1-3, may be faster, less expensive, and provide more freedom in usable helmet body shapes than conventional methods.

The non-limiting examples of a helmet 100 shown in FIGS. 1-3 comprise an upper body 102 and a lower body 104. In some embodiments, a helmet 100 may be assembled by mechanically joining two helmet bodies. In other embodiments, more than two helmet bodies may be joined using the methods contemplated herein. While many of the embodiments discussed herein focus on the mechanical joining of an upper body with a lower body, those skilled in the art will recognize that these methods and examples may be applied to helmets having more than two bodies, as well as a single body comprising multiple components, portions, or parts.

The upper body 102 and lower body 104 may include any desirable number and type of shells, layers, energy management materials, and the like known in the art for helmets. In some embodiments, a helmet body, such as the upper body 102, lower body 104, or both, may comprise or be formed of plastic, polymer, foam, or other suitable energy-absorbing material or impact liner to absorb, deflect, or otherwise manage energy and to contribute to energy management for protecting a wearer during impacts. The upper body 102 and lower body 104 can include, without limitation, expanded polystyrene (EPS), expanded polypropylene (EPP), expanded polyurethane (EPU), expanded polyolefin (EPO), or other suitable material. When formed as an in-molded helmet, the upper body 102 and lower body 104 can be formed with one or both of the upper body 102 and lower body 104 being bonded directly to each other or to an additional shell or protective shell, such as the type used in hard shell helmets or soft shell helmets. In some embodiments, a helmet body, such as the upper body 102, lower body 104, or both, may be composed entirely of energy management material. In other embodiments, a helmet body may itself be composed of multiple materials, or may be layered in nature. Advantageous over the conventional method of in-molding helmet bodies together, these joining methods may be used both with helmet bodies and materials that are compatible, and are not compatible, with in-molding. In any event, the upper body 102 and lower body 104 can absorb, attenuate, or manage energy from an impact by bending, flexing, crushing, or cracking.

The helmet body, such as the upper body 102, lower body 104, or both, may also comprise one or more shells or outer shells, which can, without limitation, be formed of a plastic, resin, fiber, or other suitable material including polycarbonate (PC), polyethylene terephthalate (PET), acrylonitrile butadiene styrene (ABS), polyethylene (PE), polyvinyl chloride (PVC), vinyl nitrile (VN), fiberglass, carbon fiber, or other similar material. The shells can be stamped, in-molded, injection molded, vacuum formed, or formed by another suitable process. The shells can provide a space into which the upper body 102 and lower body 104 may be disposed. The shells can also provide a smooth aerodynamic finish, a decorative finish, or both, for improved performance, improved aesthetics, or both. As a non-limiting example, the shells can comprise a PC shell that is in-molded in the form of a vacuum formed sheet, or is attached to the upper body 102, the lower body 104, or both, with, e.g., an adhesive. The shells, upper body 102, and lower body 104 can also be permanently or releasably coupled, using any suitable chemical or mechanical fastener or attachment device or substance including without limitation, an adhesive, permanent adhesive, PSA, foam-core adhesive, tape, two-sided tape, mounting foam adhesive, fastener, clip, cleat, cutout, tab, snap, rivet, hog ring, or hook and loop fasteners.

Figure 3A:
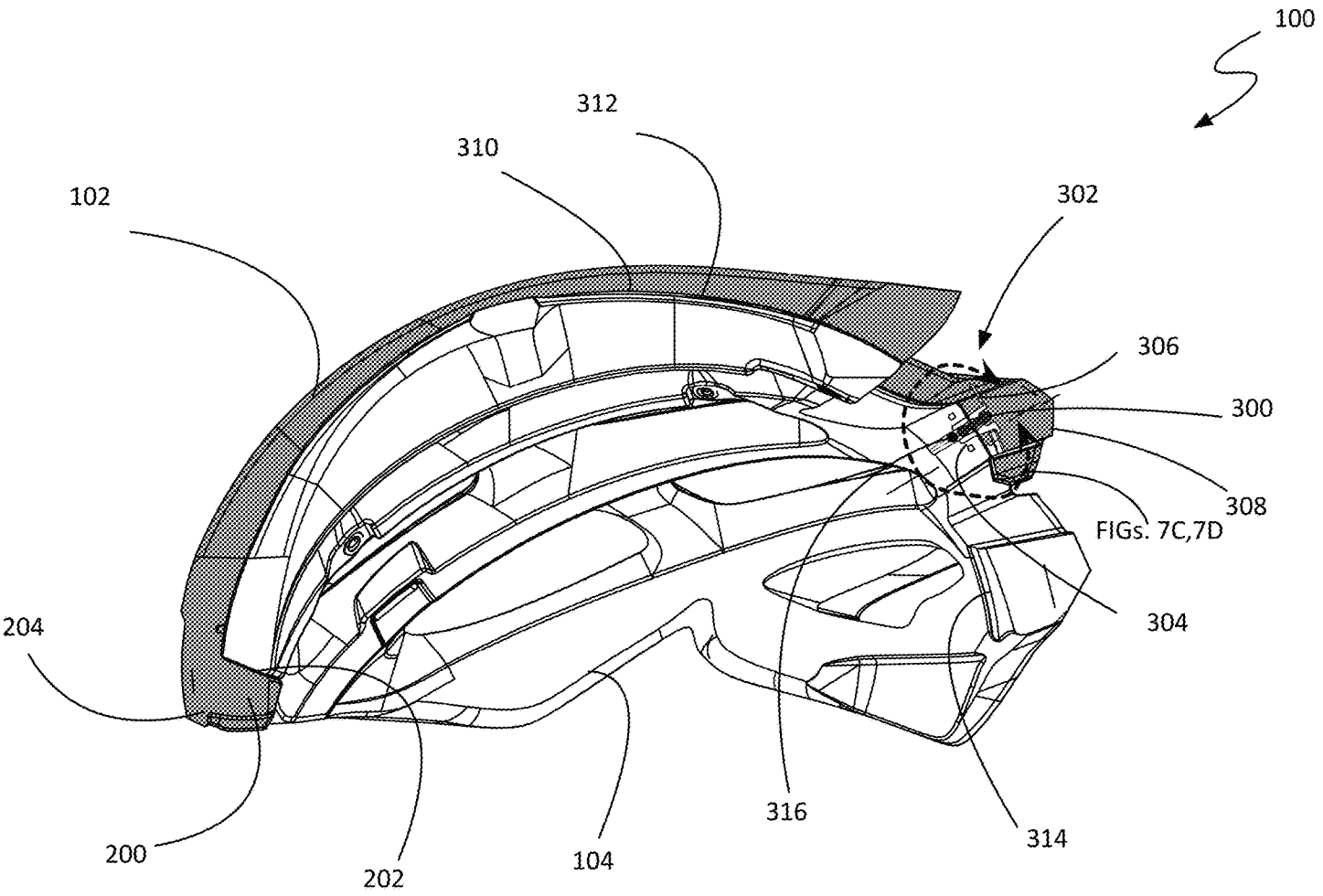
FIG. 3A is a cross-sectional side view of the helmet of FIG. 1.

FIG. 3A shows a non-limiting example of a cross-sectional side view of the helmet 100 taken along section line 3A-3B shown in FIG. 2. More specifically, FIG. 3A shows the upper body 102 is mechanically joined with the lower body 104 by a locking flange 200 and a joining pin 300. As shown, the interior surface 310 of the upper body 102 is mated with, or disposed against, an outer surface 312 of the lower body 104. In some embodiments, the contact between an upper body 102 and a lower body 104 may be continuous. In other embodiments, such as the non-limiting example shown in FIG. 7B, there may be a gap 702 between the upper and lower bodies, at least between the interior surface 310 of the upper body 102 and a portion 700 of the exterior surface of the lower body facing the interior surface 310 of the upper body. A presence of a gap between the upper body 102 and the lower body 104 can assist in energy management, and may provide for intermediate mechanical structures, such as covers for vents, and thus can enable features that might otherwise be unavailable or cost-prohibitive for unitary or monolithically formed bodies. As mentioned above, the gap between the upper body 102 and the lower body 104 may be desirable for energy management reasons, such as allowing bodies to slip against each other to absorb rotational impact energy, and could also contain materials beneficial for energy management that may not be compatible with in-molding.

As shown in FIGS. 2 and 3A, the helmet 100 can comprise a locking flange 200, which can be integrally formed as part of a monolithically formed upper helmet body 102, or alternatively a separate or discrete piece coupled to the upper helmet body 102. As a non-limiting example, the present description shows the locking flange 200 can be a projection on the interior surface 310 of the upper body 102 which obstructs movement of one or more of a particular type (e.g. rotational or linear), or a particular direction (e.g. to the front or to the side) of one helmet body (e.g. the lower body 104) with respect to another helmet body (e.g. the upper body 102). Specifically, the locking flange 200 shown in the non-limiting embodiments of FIGS. 2, 3A, and 3B can prevent the lower body 104 from rotating forward or being pulled directly downward, with respect to the upper body 102.

As shown, helmet 100 can comprise a single locking flange 200, centered near the front rim 204 of the upper body 102. In some embodiments, the locking flange 200 of an upper body 102 may be a short segment, while in others the locking flange 200 may be long. For example, in an embodiment, the locking flange 200 may extending along a majority of the front rim 204 of the upper body 102. In various embodiments, the length, thickness, or both of the locking flange 200 may depend on the properties of the material with which it and the upper body 102 are made.

In some embodiments, such as the non-limiting example shown in FIG. 2, a helmet 100 may employ a single locking flange 200. In other embodiments, the upper body 102 may comprise multiple locking flanges 200. In some embodiments, gaps between multiple locking flanges may be employed to create air channels that may facilitate ventilation through the lower body 104. In other embodiments, protrusions from the lower body 104 may fill gaps between locking flanges 200 for improved stability.

Figure 3B:
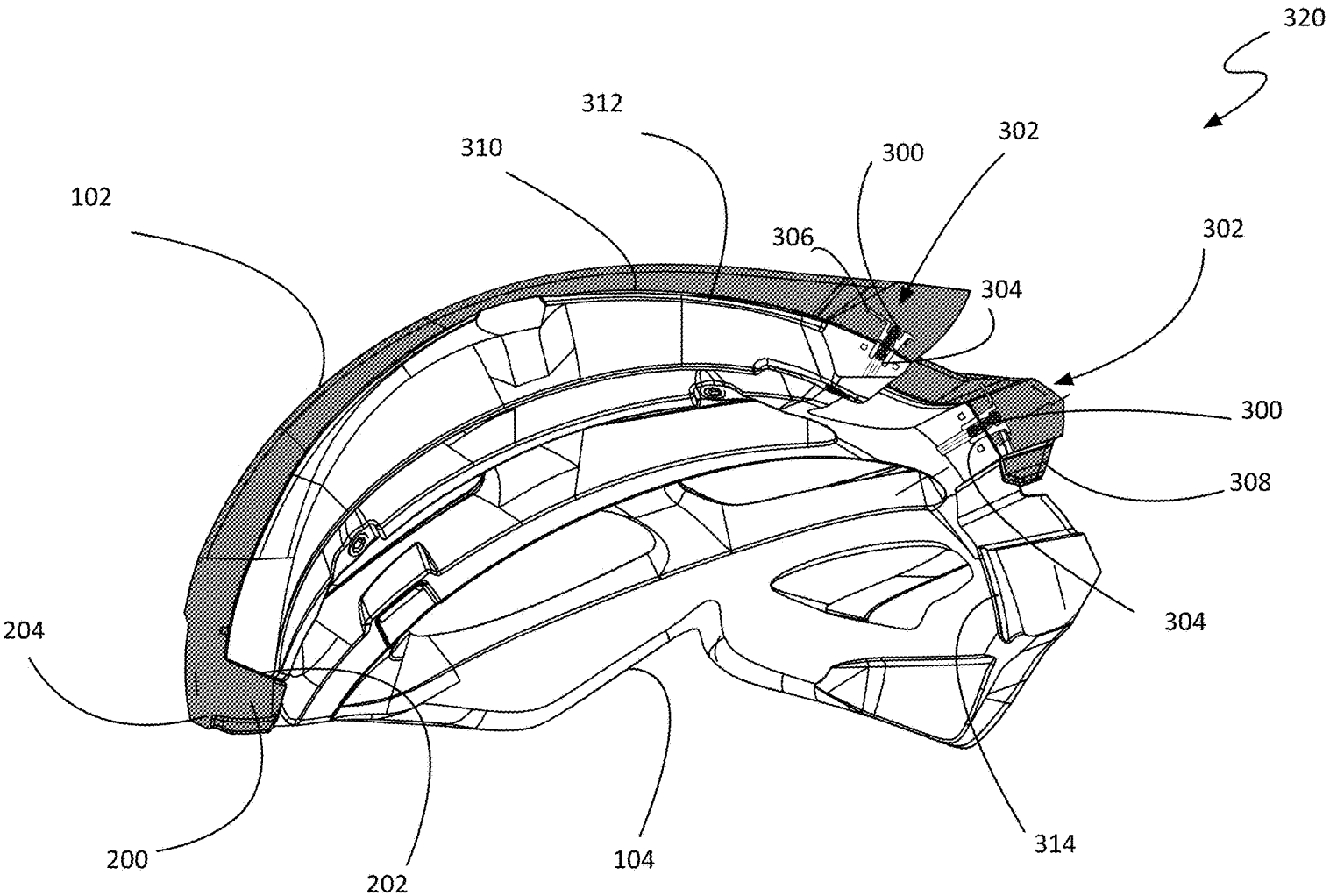
FIG. 3B is a cross-sectional side view of a helmet comprising two joining pins.

As shown in FIGS. 3A and 3B, the locking flange 200 can be mated with an edge 202 of the lower body 104. In some embodiments, the edge 202 may be friction-fit with the locking flange 200, while in others edge 202 may simply be resting against the flange 200. Furthermore, in some embodiments, a locking flange 200 may be mated with an edge 202, while in others the contact between the locking flange 200 and an edge 202 may be non-continuous.

In some embodiments, including the non-limiting examples shown in FIGS. 3A and 3B, the surface of the locking flange 200 that is facing the edge 202 may be flat. In other embodiments, the surface of the locking flange 200 that faces the edge 202 may be contoured. As an option, the contoured surface may be smooth and continuous, or it may be made up of multiple surfaces and have edges and corners. A contoured surface of interaction between a locking flange and an edge of a lower body may improve the inhibition of certain types or directions of movement (e.g. it may bolster against side to side movement between the two helmet bodies 102, 104).

The non-limiting examples of helmets 100 shown in FIGS. 2-3 have a locking flange 200 located near a front rim 204 of the upper body 102. Depending upon the intended overall helmet design, and the shape of the helmet bodies, a locking flange 200 may be positioned at a variety of locations on the interior surface 310 of the upper body, according to various embodiments. For example, in one embodiment, the upper body 102 may have a locking flange 200 located on the lateral sides or at a rear of the helmet 100.

As shown in the non-limiting examples of FIGS. 3A and 3B, the helmet 100 can comprise at least one joining pin 300. Specifically, FIG. 3A shows a helmet 100 having a single joining pin 300, while the helmet 320 shown in FIG. 3B has two joining pins 300. In the context of the present description and the claims that follow, a joining pin comprises an object that may be placed inside of two or more helmet bodies (e.g. upper body 102 and lower body 104) to bridge those bodies, joining them and preventing particular types, directions, or both of movement of one of the bridged bodies with respect to another, as discussed in greater detail with respect to FIG. 6.

The non-limiting examples shown in the figures and described herein are directed toward embodiments where an upper body 102 is joined with a lower body 104 by a joining pin 300. However, it should be understood that these methods and techniques may also be applied in embodiments where a joining pin 300 is inside of, bridges, and joins three or more helmet bodies.

In some embodiments, the joining pin 300 may be inserted directly into the material of the helmet bodies 102, 104 that are being joined. In other embodiments, the joining pin 300 may be held within one or more snap baskets, baskets, or attachment structures, while bridging the helmet bodies 102, 104. For example, each joining pin 300 in the non-limiting examples shown in FIGS. 3A and 3B is shown held inside a basket pair 302 comprising a lower basket 304 inside the lower body 104 and an upper basket 306 inside the upper body 102. Baskets such as these may serve to provide a strong, easy to assemble, economical union between the bodies 102, 104, and may also be used to prevent the joining pin 300 from being removed, once inserted, according to various embodiments. Upper baskets 306 will be discussed in greater detail with respect to FIG. 4, while lower baskets 304 will be discussed in greater detail with respect to FIG. 5.

Like a locking flange 200, a joining pin 300 may be used to prevent a particular type, direction, or both, of movement of one helmet body with respect to another, and may be used in conjunction with a locking flange. For example, in the non-limiting embodiments shown in FIGS. 3A and 3B, a joining pin 300 is used in conjunction with a locking flange 200 to join the helmet bodies and prevent the lower body 104 from being removed from inside of the upper body 102. In some embodiments, two or more helmet bodies may be joined solely using joining pins 300, such as a first joining pin 300 at a front of the helmet 100 and a second joining pin at a rear of the helmet 100. Alternatively, any number and location of joining pins according to the configuration and design of the helmet 100 can also be used. In other embodiments, two helmet bodies may be joined using a locking flange combined with another form of joining, such as those indicated above. For example, in one embodiment, two helmet bodies may be joined using a locking flange combined with an adhesive applied opposite the locking flange. This may be advantageous over using only adhesive, as a smaller amount of adhesive could be used, speeding up an assembly process and reducing helmet cost.

In various embodiments, two or more helmet bodies may be joined by one or more joining pins 300 used in conjunction with another method of joining, including but not limited to locking flanges 200, adhesives, or other methods and techniques described above. Joining a lower body 104 with an upper body 102 relying solely on locking flanges 200 would be difficult, as the lower body 104 needs to be able to be inserted into the upper body 102. However, using a locking flange 200 in conjunction with one or more joining pins 300 is advantageous in that the locking flange 200 can reduce the number of parts (e.g., joining pins) or steps needed to assemble the helmet.

As shown in FIGS. 3A and 3B, a joining pin 300 can be located proximate a rear rim 308 of the upper body 102, opposite a locking flange 200 proximate the front rim 204 of the upper body. Similar to locking flanges 200, joining pins 300 may be positioned anywhere on the helmet to prohibit a variety of types or directions of relative movement between helmet bodies, according to various embodiments. The types or directions of relative movement prohibited may depend upon the position of a joining pin 300 within a helmet 100.

In some embodiments, a joining pin 300 may be located opposite a locking flange 200. In other embodiments, a joining pin 300 may be located proximate a locking flange 200. For example, in one embodiment, a joining pin 300 may be located near a locking flange 200 while still positioned such that the combined types and directions of relative movement of helmet bodies prohibited by the locking flange 200 and joining pin 300 prevent the removal of the lower body 104 from inside the upper body 102.

The non-limiting embodiment shown in FIG. 3A employs a single joining pin 300, while the non-limiting embodiment shown in FIG. 3B uses two joining pins 300. According to various embodiments, multiple joining pins 300 may be used to join a lower body 104 with an upper body 102. For example, in one embodiment where the upper and lower bodies comprise a number of delicate features (e.g. shapes having many voids to improve ventilation), it may be desirable to distribute any strain put on the joined bodies (e.g. force applied to the upper body while the lower body is in contact with a head) across a number of locations bridged by joining pins rather than allowing a single joining pin to receive all the strain or loading.

In the non-limiting examples shown in FIGS. 3A, 3B, 7C, and 7D, a joining pin 300 is inserted through an interior surface 314 of the lower body 104. In some embodiments, joining pins 300 may be inserted into the helmet bodies through an interior surface of the lower body 104. Such an insertion point may be covered up by a fit system or padding sometimes employed in conventional helmets, and would not require an opening in any sort of outer shell formed on the upper body 102. In other embodiments, joining pins 30 may be inserted through an exterior surface of the upper body 102.

In some embodiments, a joining pin 300 may be inserted to bridge two helmet bodies by piercing the helmet bodies with the joining pin. In other embodiments, including those shown in FIGS. 3 and 7, a joining pin 300 may be inserted through a channel 318 formed in at least one of the helmet bodies. Use of a channel 318 can facilitate proper placement of the pin 300 when joining one or more baskets 304, 306, whereas without a formed channel, it may be difficult to locate a basket 304, 306 embedded within a helmet body for insertion.

In some embodiments, the joining pin 300 may be inserted directly into the material of the upper body 102 and the lower body 104 to join the bodies. In other embodiments, the joining pin 300 may be inserted into one or more baskets, such as the non-limiting examples of baskets 304, 306 shown in FIGS. 4 and 5. According to various embodiments, joining pins 300 may be composed of materials that are harder, tougher, stiffer, or stronger than the energy absorbing materials used in helmet bodies 102, 104. In such embodiments, directly inserting the joining pin 300 into the helmet bodies 102, 104, may over time, result in a deformation of the helmet body material around the pin 300 caused by the pin 30 compressing, cracking, piercing, or otherwise deforming the material of the helmet bodies, 102, 104. Such deformation of the helmet bodies 102, 104 could allow the helmet bodies to move relative to each other and possibly be separated. However, inserting the same pin 300 into a basket pair 302, when the pin 300 and the basket pair 302 are made of the same or similar material may delay, reduce, or prevent damage to the helmet bodies 102, 104, and possible loosening of the pin 300 by having the basket pairs 302 spreading or transferring forces from the pin 300 across a larger area of the basket pairs 302. The use of one or more baskets 304, 306 in conjunction with a joining pin 300 may result in a stronger, more durable coupling between helmet bodies 102, 104, according to various embodiments. Additionally, baskets 304, 306 such as those shown in FIGS. 4 and 5 may trap an inserted joining pin 300, according to some embodiments. Capturing a joining pin 300 inside a basket or basket pair 302 such that it cannot easily be removed may result in a stronger, more reliable coupling between helmet bodies.

Baskets 304, 306 meant to contain a joining pin 300 may be composed of a variety of materials, according to various embodiments. In some embodiments, baskets may be composed of a thermoplastic, such as nylon, or other plastics known in the art. In other embodiments, baskets may be composed of metallic materials, wood, cellulose, fiber, fiberglass, carbon fiber, textiles, or other similar materials.

Figure 4:
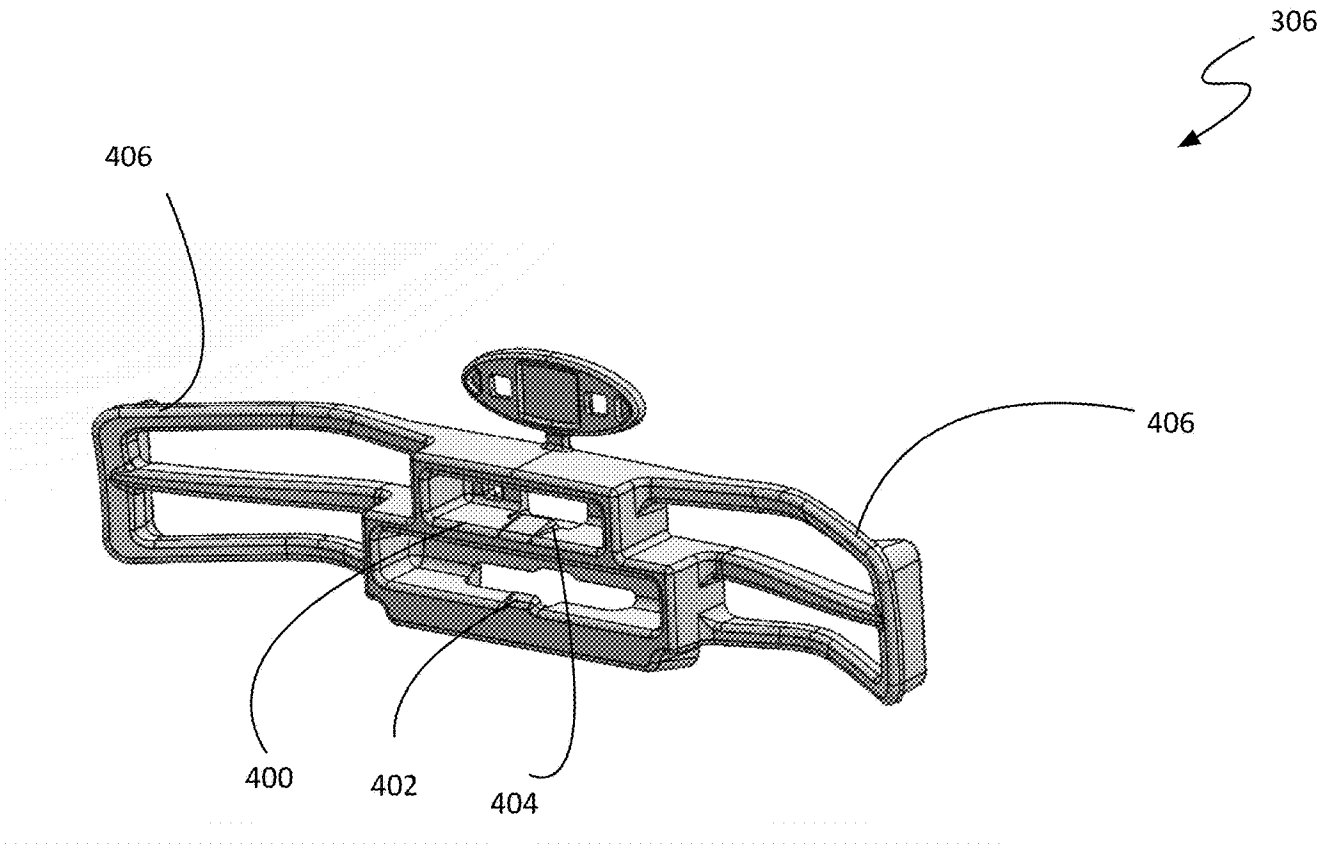
FIG. 4 is a perspective view of an embodiment of an upper basket.

FIG. 4 shows a non-limiting example of an upper basket 306 having a pin receiver 400, a barb 404, and an anchor 402. In the context of the present description, an upper basket 306 can be a structure configured to be at least partially embedded within the upper body 102 and capable of receiving the joining pin 300. The exemplary embodiment shown in FIG. 4 comprises wings, supports, flanges, or net 406 on either side, increasing the surface area of interaction with the material of the upper body 102 in which it is embedded, providing stability to the joining pin 300 and anything else coupled to the upper basket 306. In some embodiments, an upper basket 306 may be embedded in an upper body 102 during an injection molding process, or in-molded, as is known in the art. In other embodiments, an upper basket 306 may be incorporated into an upper body 102 after the upper body 102 has been formed through a variety of techniques including but not limited to adhesives and direct insertion. The geometry of an upper basket 306 may depend upon how it is to be incorporated into an upper body 102 (e.g. wings 406 are well adapted for in-molding, a threaded outer surface may be well adapted for insertion after body formation), according to various embodiments.

As shown, the upper basket 306 of FIG. 4 comprises a pin receiver 400. In the context of the present description, a pin receiver 400 can be a structure within a basket adapted to contain at least the leading portion of a joining pin 300. The leading portion of a joining pin 300 can be the portion first inserted into the helmet bodies 102, 104. In some embodiments, including the non-limiting example shown in FIG. 4, the pin receiver 400 may comprise a barrier that prevents the joining pin 300 from being inserted beyond the pin receiver 400. In other embodiments, a pin receiver 400 may be open-ended, allowing a joining pin 300 to pass completely through if insertion is not terminated.

According to some embodiments, an upper basket 306 may serve to trap a joining pin 300 such that once inserted, it is not easily removed. According to some embodiments, a barb 404 may be used to capture a joining pin 300 within a basket. A barb 404, and capturing joining pins in general, is discussed in greater detail with respect to FIGS. 7C and 7D.

According to some embodiments, a basket may further comprise a structure to facilitate the coupling of other objects to a helmet body, in addition to the joining of one helmet body to another. For example, the non-limiting embodiment of an upper basket 306 shown in FIG. 4 comprises an anchor 402 to which a strap may be attached. In some embodiments, an anchor 402 may be embedded within a helmet body and may require a channel through the helmet body to allow attachment to the anchor. In other embodiments, an anchor 402 may be positioned outside a helmet body to allow for easier access or positioning for coupling a particular item or type of item, such as a camera. According to various embodiments, an upper basket 306 may comprise one or more anchors 402 configured to couple with straps, fit systems, accessories such as cameras and lights, and other items known in the art that may be coupled to a helmet.

Figure 5:
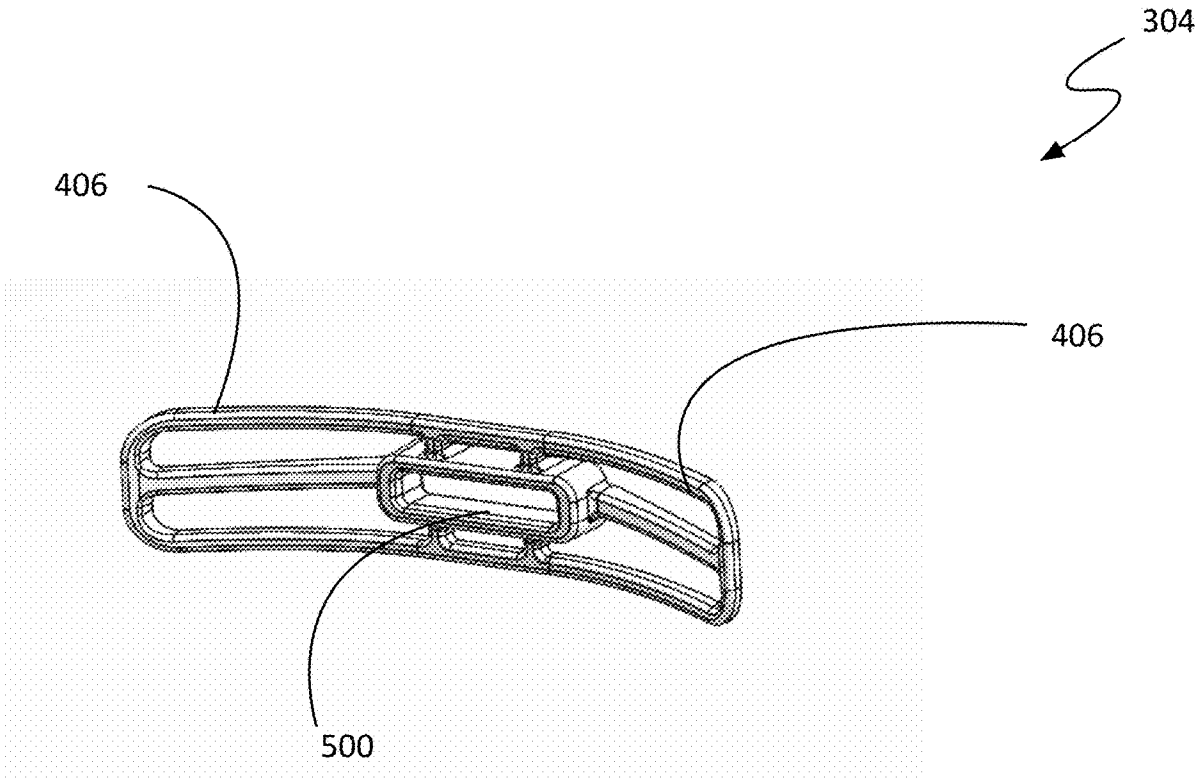
FIG. 5 is a perspective view of an embodiment of a lower basket.

FIG. 5 shows a non-limiting example of a lower basket 304 having a pin aperture 500. In the context of the present description and the claims that follow, a lower basket 304 is a structure configured to be at least partially embedded within a lower body 104 and capable of receiving a joining pin 300. Like the non-limiting example of an upper basket 306 shown in FIG. 4, the lower basket 304 shown in FIG. 5 has wings 406 on either side, advantageous for embedding the lower basket 304 in a lower body 104 during a molding process, as is known in the art. Similar to an upper basket 306, a lower basket 304 may also be incorporated into a helmet body after it has been formed, according to various embodiments.

As shown, the lower basket 304 of FIG. 5 comprises a pin aperture 500. In the context of the present description and the claims that follow, a pin aperture 500 is a structure within a basket adapted to contain at least a portion of a joining pin 300. Unlike some embodiments of a pin receiver 400, a pin aperture 500 can be open ended. Furthermore, the pin aperture 500 shown in FIG. 5 need not be configured to capture or trap a joining pin 300. However, in various embodiments, a pin aperture 500 may be configured to trap a joining pin 300.

As shown in the non-limiting examples of FIGS. 4 and 5, the upper basket 306 can comprise a pin receiver 400, while the lower basket 304 comprises a pin aperture 500. Such an arrangement is configured for insertion of a joining pin 300 into the basket pair through an interior surface 314 of the lower body. In embodiments where a joining pin 300 is inserted into a basket pair 302 through an exterior surface of the upper body, the upper basket may comprise a pin aperture 500 while the lower basket comprises a pin receiver 400.

Figure 6:
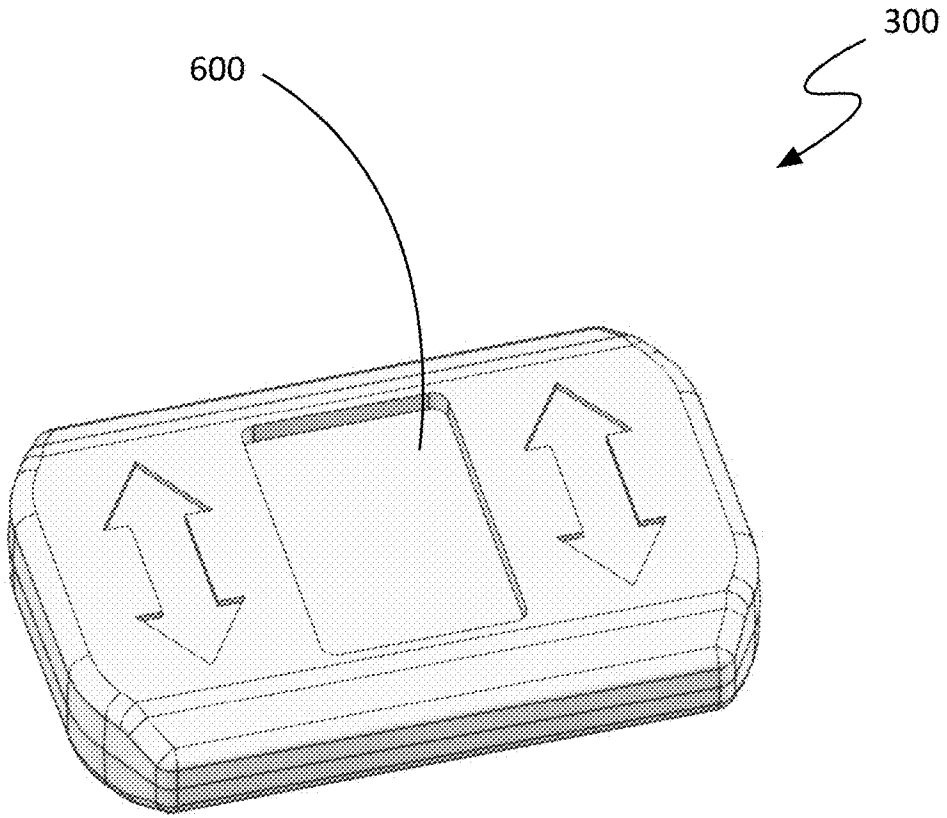
FIG. 6 is a perspective view of an embodiment of a joining pin.

FIG. 6 shows a non-limiting example of a joining pin 300. As stated before, a joining pin is an object that may be placed inside of two or more helmet bodies (e.g. upper body 102 and lower body 104) to bridge those bodies, joining them and preventing particular types or directions of movement of one of the bridged bodies with respect to another. A joining pin 300 may be constructed of any material known in the art, including but not limited to thermoplastics such as nylon and injection mold plastics, as well as metallic materials, or any other suitable material.

The non-limiting example of a joining pin 300 shown in FIG. 6 is a flat, rounded rectangle. In other embodiments, a joining pin 300 may be one of a variety of shapes. As a specific example, in one embodiment, the joining pin may be cylindrical, which may be advantageous for joining pins inserted directly into the material of helmet bodies. In other embodiments, the joining pin 300 may have an irregular polygonal shape or an oval cylindrical shape or any other shape forming an elongated pin for restricting relative movement of helmet bodies, as previously discussed. A size or dimensions of the joining pin 300 may be of any size that fits or works in conjunction with the helmet 100, including a length L in a range of 1-40 millimeters (mm), 3-30 mm, or 7-15 mm. A width or diameter W of the joining pin 300 may be in a range of 1-40 mm, 2-15 mm, or 4-8 mm. A thickness or diameter T of the joining pin 300 may be in a range of 0-10 mm, 1-5 mm, or 1-3 mm.

The non-limiting example of a joining pin 300 shown in FIG. 6 is adapted for use in conjunction with a basket pair 302. In other embodiments, a joining pin may have different geometry advantageous for direct insertion into helmet body material. For example, in one embodiment, a joining pin 300 may have series of narrow fins which may increase the surface area of interaction between the pin and the material of a helmet body, providing improved grip.

According to some embodiments, a joining pin 300 may be trapped, or releasably coupled, within a basket or basket pair 302. For example, in the non-limiting embodiment of a joining pin 300 shown in FIG. 6, the joining pin 300 comprises a catch 600. A catch 600 may be paired with a barb 404 to capture a joining pin 300 in a basket or basket pair 302. In some embodiments, a catch 600 may be an indentation in a joining pin 300, while in others a catch 600 may be defined by a projection extending out from the surface of a pin. Catches and barbs will be discussed in greater detail with respect to FIGS. 7C and 7D.

In some embodiments, a joining pin 300 may be designed to facilitate quick insertion. For example, the non-limiting embodiment shown in FIG. 6 may be inserted either side up, in one of two directions (as indicated by the arrows on the surface). In other embodiments, a joining pin may be shaped such that it may be inserted from any direction. However, in some embodiments, the pin 300 may be shaped to give it strength against strain caused by attempts to move helmet bodies in a particular direction or manner, and such strengthening may result in the pin needing to be inserted in a particular direction.

Figure 7A:
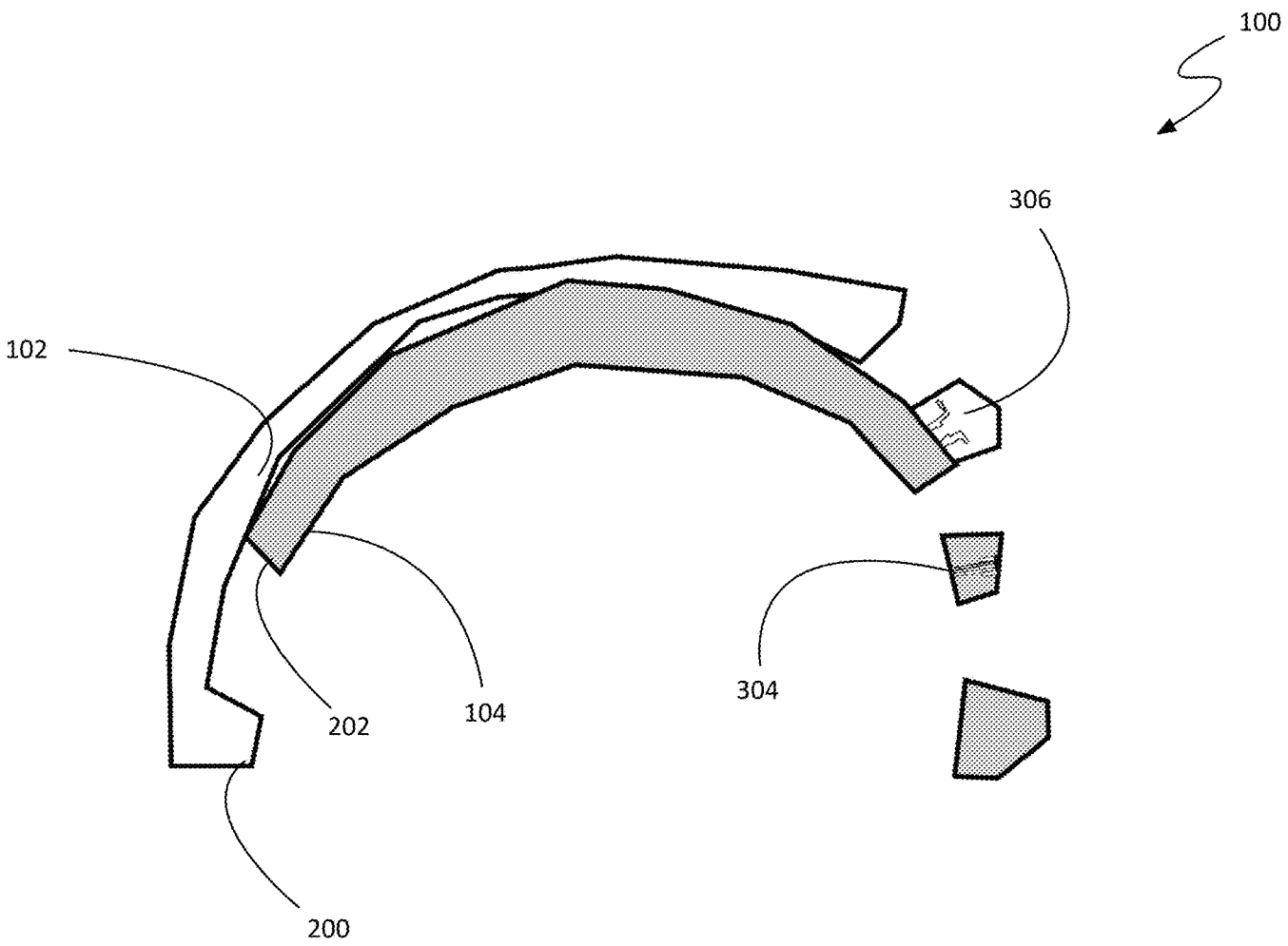
FIG. 7A is a cross-sectional view of a lower body being rotated within an upper body.
Figure 7B:
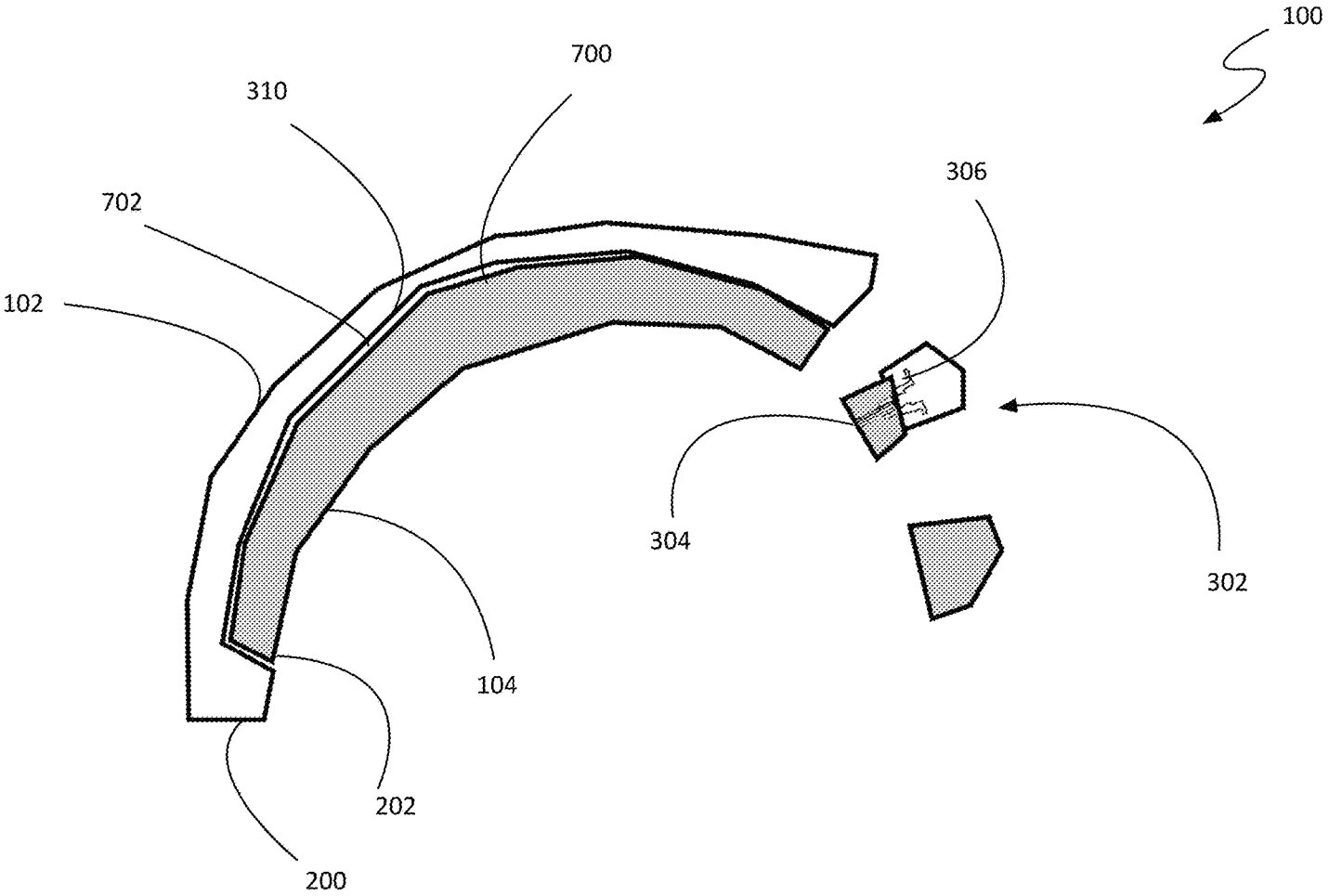
FIG. 7B is a cross-sectional view of a lower body aligned with an upper body.
Figure 7C:
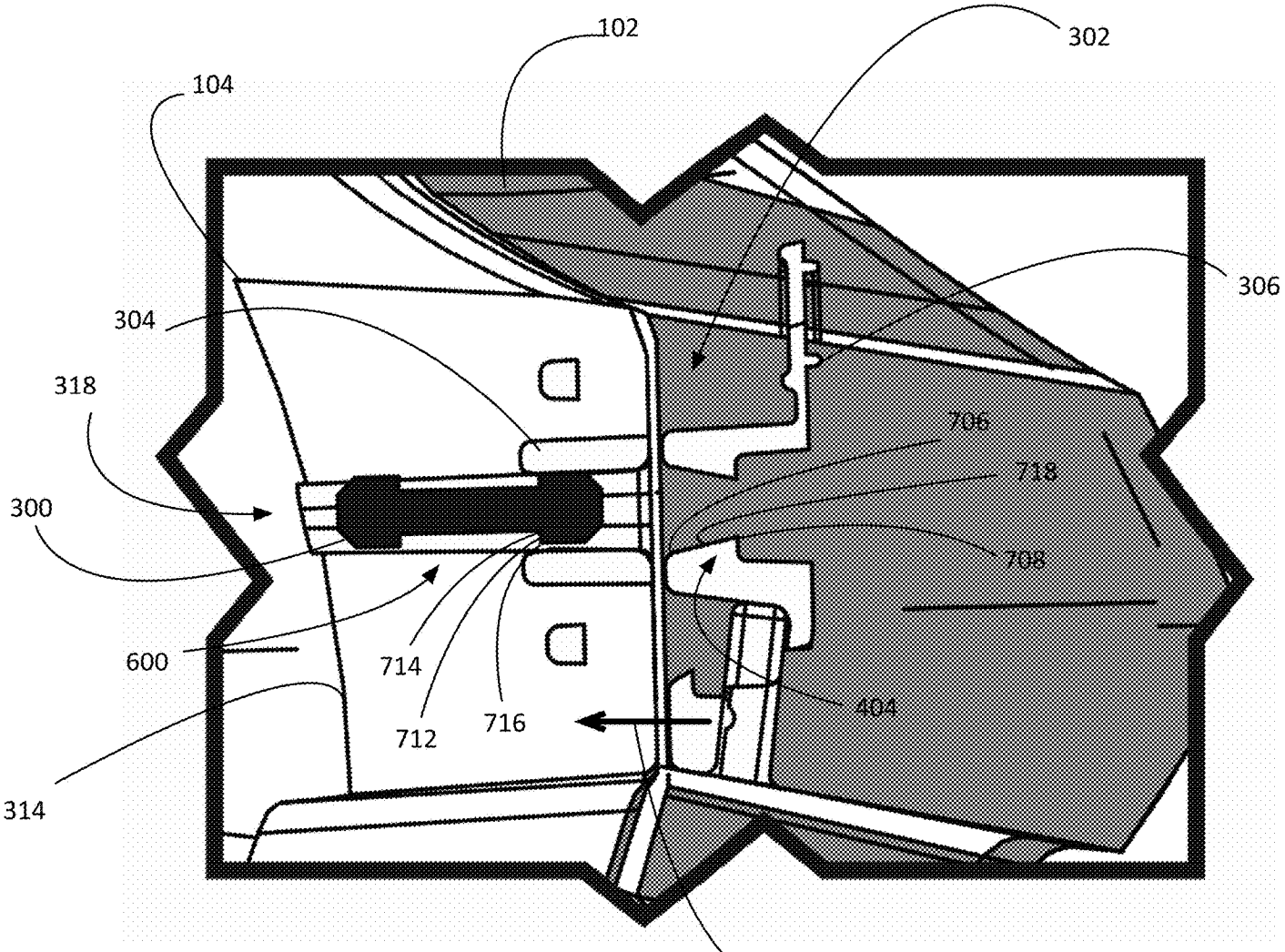
FIG. 7C is a close-up cross-sectional view of a joining pin being inserted into a basket pair.

FIGS. 7A-7C show a non-limiting example of a helmet 100 being assembled, joining an upper body 102 with a lower body 104 using a locking flange 200 and a joining pin 300. FIGS. 7A and 7B show a lower body 104 being fit inside an upper body 102 and rotated until an edge 202 of the lower body 104 is in contact with a locking flange 200 of the upper body 102. As shown in FIG. 7B, when the lower body 104 has been fully rotated to engage with the locking flange 200 of the upper body 102, the lower basket 304 is aligned with the upper basket 306 to form a basket pair 302.

FIG. 7C shows a joining pin 300 being inserted into a channel 318 on the interior surface 314 of the lower body 104. In some embodiments, a joining pin 300 may be inserted manually, while in others the insertion may be performed by a machine. According to various embodiments, once the pin 300 is inside the channel 318, a tool or other elongated implement may be used to push the joining pin 300 into a basket pair 302.

According to various embodiments, a joining pin 300 may be trapped inside a basket or basket pair 302 by various structures, designs, or arrangements. For example, in one embodiment, an adhesive may be applied to the joining pin 300 after insertion into a basket. In other embodiments, a joining pin 300 may be adhered directly to the material of a helmet body.

In other embodiments, a joining pin 300 may be trapped within a basket or basket pair 302 through the interaction of complimentary structures, such as a catch and a barb. As shown in the non-limiting example of FIG. 7C, the joining pin 300 comprises a catch 600 having a retention surface 712. In the context of the present description, a retention surface 712 is a surface on a catch configured to constrain movement of a barb once a relative position of the barb and catch has been achieved. As shown, a retention surface 712 can extend from a catch base 714 to a catch peak 716.

Furthermore, as shown in FIG. 7C, the pin receiver of the upper basket 306 can comprise two barbs 404, each having an insertion surface 718. In the context of the present description, an insertion surface 718 can be a surface on a barb 404 that extends from a barb base 706 to a barb peak 708, and can be angled away from both the barb base 706 and a relative direction of motion 710 of the barb during insertion of the pin into the basket. In some embodiments, a joining pin 300 may have one or more catches, and one or both baskets of a basket pair 302 may have one or more barbs. In other embodiments, the pin 300 may have one or more barbs, and one or more catches may be located within the basket pair.

Figure 7D:
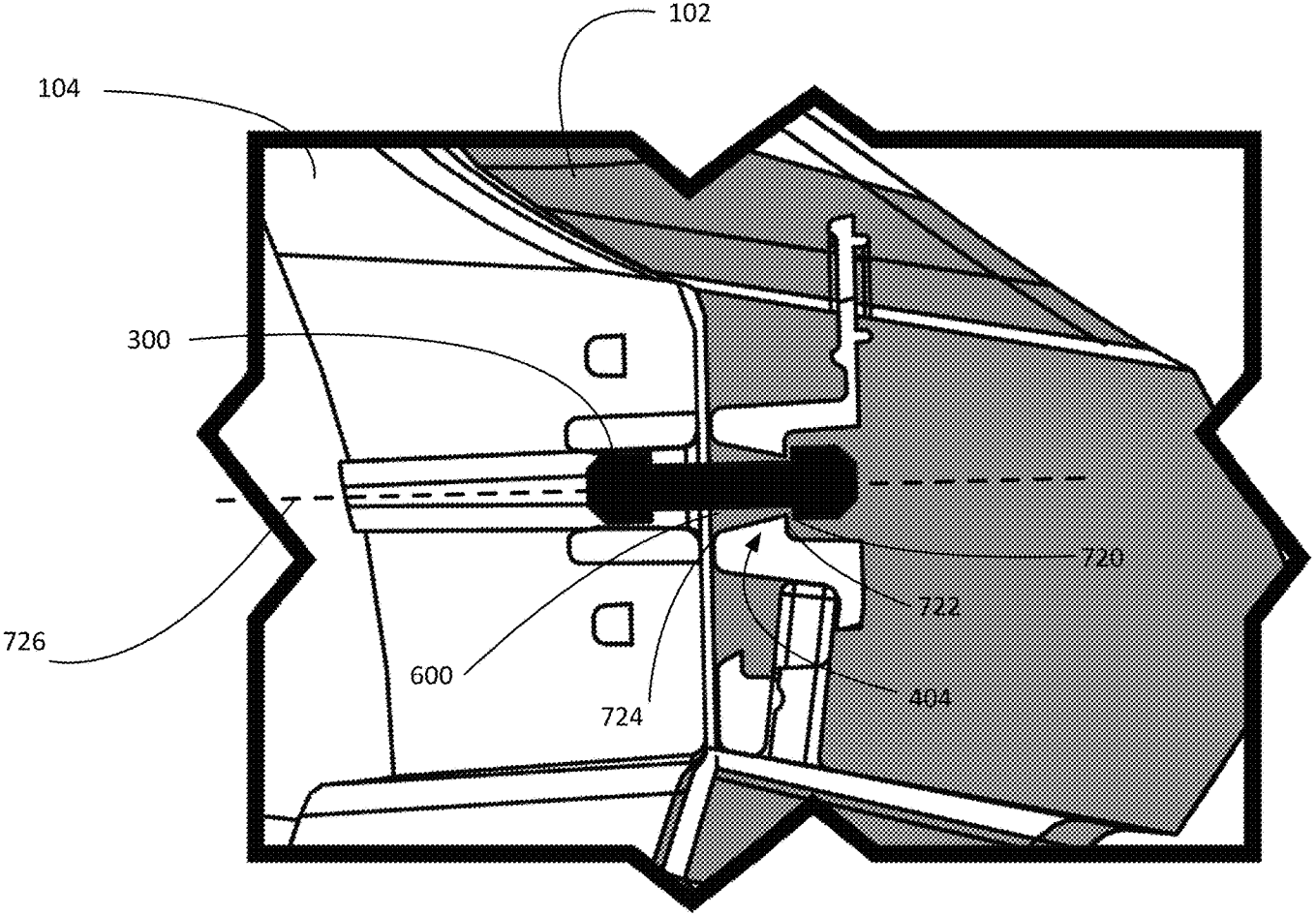
FIG. 7D is a close-up cross-sectional view of a joining pin being captured within a basket pair.

FIG. 7D shows a pin trapped in a basket pair according to an embodiment. FIG. 7D shows the joining pin 300 trapped within the basket pair 302, after being inserted along an insertion path 726 until the displacement of a leading peak 720 from the insertion path 726 is greater than the displacement of a trailing peak 722 from the insertion path 726 and less than the displacement of a trailing base 724 from the insertion path 726. In the context of the present description, a leading peak 720 is a peak, either the barb peak 708 or the catch peak 716, farthest away from the interior surface 314 of the lower body proximate the insertion path 726. Furthermore, a trailing peak 722 can be a peak, the barb peak 708 or the catch peak 716, which is not the leading peak. The trailing base 724 can be the base, either the barb base 706 or the catch base 714, which can be part of the same surface as the trailing peak 722. When such conditions are met, the barb collides with the catch, preventing the joining pin 300 from being removed from the basket pair 302. In other words, when the joining pin 300 of FIG. 7C is inserted into the basket pair 302, the barb 404 of the upper basket 306 can deflects when the pin 300 hits the insertion surface 718. Once the pin 300 is fully inserted, the barb 404 can drop into the catch 600 of the pin 300, trapping the pin 300, either permanently or releasably.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and assembly methods, it should be readily apparent that a number of modifications may be made without departing from the spirit thereof and that these embodiments and implementations may be applied to other to helmet assembly technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet, comprising:

an upper body comprising an interior surface comprising a locking flange integral with the upper body and protruding from the interior surface;

a majority of a lower body positioned inside the upper body, the lower body comprising a peripheral edge in contact with the locking flange of the upper body;

at least one joining pin, separate from the locking flange, located within both the lower body and the upper body, bridging the lower body and the upper body; and at least one basket pair comprising:

an upper basket comprising a pin receiver, the upper basket at least partially embedded within the upper body, a lower basket comprising a pin aperture, the lower basket at least partially embedded within the lower body and positioned such that the pin aperture is aligned with the pin receiver of the basket pair, and the at least one joining pin positioned inside both the pin aperture and the pin receiver of the basket pair.

2. The helmet of claim 1, wherein the locking flange is proximate a front rim of the upper body, and the at least one joining pin is proximate a rear rim of the upper body.

3. The helmet of claim 1, wherein:

the upper basket of the at least one basket pair is in-molded within the upper body; and the lower basket of the at least one basket pair is in-molded within the lower body.

4. The helmet of claim 1, wherein the at least one joining pin is releasably coupled to at least one of the pin receiver and the pin aperture of the at least one basket pair.

5. The helmet of claim 1, wherein at least a portion of an exterior surface of the lower body facing the interior surface of the upper body is separated from the interior surface by an air gap.

6. The helmet of claim 1, wherein the at least one joining pin is a single joining pin.

7. The helmet of claim 1, wherein the at least one joining pin is fixedly coupled to at least one of the upper body and the lower body with an adhesive.

8. A helmet, comprising:

an upper body comprising a first impact liner composed of an energy-absorbing material;

a lower body comprising a second impact liner composed of an energy-absorbing material having a majority of the second impact liner positioned inside the upper body;

at least one joining pin located within both the lower body and the upper body, bridging and coupling the lower body to the upper body; and a basket pair, comprising:

an upper basket comprising a pin receiver, the upper basket at least partially embedded within the upper body, and a lower basket comprising a pin aperture, the lower basket at least partially embedded within the lower body and positioned such that the pin aperture is aligned with the pin receiver of the basket pair;

wherein one of the at least one joining pin is positioned inside both the pin aperture and the pin receiver of the basket pair.

9. The helmet of claim 8, wherein:

the upper body comprises an interior surface comprising a locking flange integral with the upper body, protruding from the interior surface and separate from the at least one joining pin; and the lower body comprises a peripheral edge in contact with the locking flange of the upper body.

10. The helmet of claim 9, wherein the locking flange is proximate a front rim of the upper body, and the at least one joining pin is proximate a rear rim of the upper body.

11. The helmet of claim 8, wherein at least a portion of an exterior surface of the lower body facing an interior surface of the upper body is separated from the interior surface by an air gap.

12. The helmet of claim 8, wherein the at least one joining pin is a single joining pin.

13. The helmet of claim 8, wherein the at least one joining pin is at least two joining pins.

14. The helmet of claim 8, wherein one of the at least one joining pin is releasably coupled to at least one of the pin receiver and the pin aperture of the respective basket pair.

15. The helmet of claim 8, wherein:

the upper basket of the basket pair is in-molded within the upper body, and the lower basket of the basket pair is in-molded within the lower body.

16. A method of assembling a helmet comprising an upper body and a lower body, comprising:

providing an upper body of the helmet having a first impact liner composed of an energy-absorbing material;

inserting a majority of a lower body of the helmet into the upper body of the helmet, the lower body having a second impact liner composed of an energy-absorbing material;

rotating the lower body within the upper body until a peripheral edge of the lower body is in contact with a locking flange, separate from the joining pin, protruding from an interior surface of the upper body; and inserting a joining pin into both the lower body and the upper body through an interior surface of the lower body after inserting the majority of the lower body of the helmet into the upper body of the helmet, such that the joining pin bridges and couples the lower body and the upper body and fixes a position of the lower body within the upper body.

17. The method of claim 16, further comprising:

aligning the lower body with the upper body to form a basket pair comprising an upper basket in-molded within the upper body and a lower basket in-molded within the lower body, the lower basket comprising a pin aperture aligned with a pin receiver of the upper basket; and inserting the joining pin into both the lower body and the upper body by inserting the joining pin into the pin aperture and the pin receiver of the basket pair.

18. The helmet of claim 17, wherein the joining pin is releasably coupled to at least one of the pin receiver and the pin aperture of the respective basket pair.

* * * * *